United States Patent [19]

Maas et al.

[11] Patent Number: 4,701,254

[45] Date of Patent: Oct. 20, 1987

[54] STATIC BED WAX DECOLORIZATION PROCESS

[75] Inventors: Lawrence W. Maas, Pasadena; Richard A. Geiman; Charles T. Adams, both of Houston, all of Tex.

[73] Assignee: Shell Oil Company, Houston, Tex.

[21] Appl. No.: 922,905

[22] Filed: Oct. 24, 1986

Related U.S. Application Data

[63] Continuation-in-part of Ser. No. 758,181, Jul. 23, 1985, abandoned.

[51] Int. Cl.[4] ..... C10G 73/42

[52] U.S. Cl. ..... 208/26; 208/299; 208/310 R

[58] Field of Search ..... 208/24, 27, 26, 297, 208/299, 310 R, 210 PP; 585/820

[56] References Cited

U.S. PATENT DOCUMENTS 3,908,002 9/1975 Holler ..... 423/628
4,003,851 1/1977 Ebel et al. ..... 252/465
4,301,037 11/1981 Kim et al. .
4,379,134 4/1983 Weber et al. ..... 423/626

*Primary Examiner*—Andrew Metz
*Assistant Examiner*—Glenn Caldarola
*Attorney, Agent, or Firm*—Kimbley L. Muller

[57] ABSTRACT

A process is disclosed for removing color or color inducing impurities to petroleum derived wax by means of an adsorbent comprising a refined inorganic oxide having a pore distribution such that at least 60% of the pores possess a size of less than 350 Angstroms. Preferably, at least 90% of the pores possess a size of less than 350 Angstroms. The preferred inorganic oxide is an aluminum oxide and preferably has a surface area between 200 square meters per gram and 500 square meters per gram. A process is also disclosed for wax finishing utilizing multiple beds of refined alumina which may be operated in a swing bed fashion to intimately regenerate the refined alumina absorbent by such procedural steps as naphtha soaking, steam treating and heating in air.

15 Claims, 3 Drawing Figures

STATIC BED WAX DECOLORIZATION PROCESS

This application is a continuation-in-part of Ser. No. 758,181, filed July 23, 1985 and now abandoned and which incorporates all of the teachings by reference.

FIELD OF INVENTION

This invention concerns a wax finishing process for high carbon atom paraffinic wax materials having color impurities or color precursor impurities therein. It is common practice of refiners to treat various lubricating oils to remove the wax content of same. Even with the advent of catalytic dewaxing of lubricating oils in the presence of hydrogen a number of solvent treating systems are still necessary to economically dewax the lubricating oils while concomitantly providing industry with a source of petroleum-derived wax. The most-used solvent for such systems is usually lower alkyl ketones in combination with an aromatic solvent, such as benzene or toluene. Solvent dewaxing is typically employed in the manufacture of paraffinic based lube oil stocks, such as a HVI 100, HVI 250, HVI 500 to 650 or Bright stock lube oil.

The effluent from a solvent dewaxing unit will generally comprise a dewaxed lubricating oil, soft wax (sometimes referred to as footsoil) and hard wax. The latter component is separated from the two former components and found to generally comprise either paraffin waxes, microcrystalline waxes or mixtures of both together with colored or color-forming impurities. The normal paraffin waxes are generally straight chain, saturated hydrocarbons which are brittle and relatively light in color. There is also found some isoparaffin and cycloparaffin material in addition to residuum ketone (such as methylethyl ketone) and residuum benzene or toluene solvent. The average molecular weights of these paraffin waxes range from 345 to 500 and encompass paraffinic material having carbon numbers on the order of from 18 to 60. The melting point of these waxes is usually as low as 110° F. but can be as high as 200° F. or more. The microcrystalline waxes are usually derived from processing a Bright stock lubricating oil. The Molecular weights of these microcrystalline waxes are heavier than the paraffinic waxes and usually average a molecular weight of about 675 with an average carbon number of $C_{48}$. The microcrystalline waxes are present also with a residuum amount of a ketone (such as methylethyl ketone) and the applicable aromatic solvent. Both of these wax entities are usually found in combination with one another although the derivation of a sole paraffin or sole microcrystalline wax can be equally treated within the realm of this invention.

BACKGROUND OF THE INVENTION

There are two major uses for decolored wax encompassing candle manufacture and paper coatings. In addition, other utility for these waxes concern preservative coatings obtained by dipping or emulsion of the item to be preserved in a wax stream. In order to have a salable commercial product the particular wax must meet certain color specificities. The paraffinic wax is tested against Saybolt Color Test ASTM D-156. The waxes are usually derived from distillate as colored distillate wax. The ultimate Saybolt color value can only be measured against the contemplated end-use of the product. The microcrystalline wax is usually of a darker color, even in the finished product, which is measured by ASTM Color Test D-1500. Here, a value of less than 2.0 is usually considered synonymous with a high grade wax.

The basic concept of removing color forming impurities from these types of wax streams has been practiced in the field for many years. Currently, the wax is sometimes process-finished by percolation through a bed of bauxite clay. The latter is derived usually by rudimentary mining techniques to acquire bauxite mineral ore which will contain mostly hydrated impure aluminum oxide with ancillary quantities of silica, titania, kaolinite and hematite. Greater than 50% of the pore size of bauxite are larger than 350 A. No more than 60% of the pores are of a size less than 350 A. While not wishing to be bound by any theory in regard to this invention, applicants have now discovered a criticality in the pore size distribution of the adsorbents. One adsorbent which has been determined to greatly outperform other conventional adsorbents has less than 10% of the pores of a size of greater than 350 A. This criticality is very important because regeneration conditions can be carefully chosen to mitigate change in the pore size distribution and thereby preserve the life and quality of the adsorbent.

It was surprising and totally unexpected, and, as shown in FIG. 3 herein completely unpredictable that by using refined aluminum oxide having at least 60% and preferably more than 90% of the pore size less than 350 A as an absorbent, in contradistinction to bauxite, that the static bed adsorbent system becomes as much as 200 percent more efficient. And implementation of the instant refined aluminum oxide with prescribed pore size distribution will result in lower maintenance cost, lower operation cost and a mitigation of environmental hazards, at least as they relate to the regeneration aspects of the adsorbent bed.

Two U.S. patents issued in the late 1930's, Breth et al U.S. Pat. Nos. 2,121,518 and 2,170,628 disclose a process for removal of discoloring agents from petrolatum, including waxes, by the use of a bauxite adsorbent. Prior to use of the bauxite, heating is undertaken at 600° to 1600° F. After exhaustion of the bauxite it is regenerated by a similar high temperature heat treatment. It has been determined that whatever pore structure the bauxite would possess having pores less than 350 Å would probably be destroyed in this preheat or regeneration step of the patentees. In Hess et al, U.S Pat. No. 3,258,417, a process is described for dewaxing by contact with a molecular sieve adsorbent. The principal object of the patentee's disclosure is to provide an improved method for the removal of wax from oils, natural or synthetic.

A decoloring process for waxes is described in Dole U.S. Pat. No. 2,554,244 comprising subjecting a crude wax to treatment with bauxite at high and low temperatures. The multi-temperature level processing produces a highly refined, highly stable, low melting point wax. Decolorization of hydrocarbon oils is performed in the presence of uncalcined, non-activated alumina according to the disclosure of U.S. Pat. No. 2,926,135, Engel et al. It is preferred that the starting adsorbent is used in a particle size of 0.25 to 5 mm and is impregnated with a quantity of an aqueous solution of an aluminum salt which is sufficient to fill the pores of the alumina particles. In processes where bauxite is used in the filtration of waxes, a regeneration scheme, as exemplified by Robertson et al, U.S. Pat. No. 2,496,942 is usually employed to renovate the bauxite at heating conditions of between 600° and 1600° F. This severe renovation technique can destroy most of the small Angstrom-sized pores and acts to depreciate the quality of the absorbent in decolorizing a wax. Finally, U.S. Pat. No. 4,301,037, Sanchez et al, discloses an extruded alumina catalyst support having controlled distribution of pore sizes. As shown in FIG. 1 of the patent, over 70% of the pore sizes are micropores with specific distribution of the macro and intermediate pores of the sieve. There is no disclosure of use of any type of micropore refractory oxide sieve for wax decolorization.

OBJECTS AND EMBODIMENTS

It is therefore an object of this invention to provide a more efficient wax decoloration process, commonly denoted as wax finishing.

It is also an object of this invention to provide an economical wax finishing process of lower maintenance cost to remove color forming impurities or precursors of same.

It is another object of this invention to provide a wax finishing process to treat, in a more efficient manner, wax containing color impurities to an extent that the resultant wax finished product is tested against ASTM Color Test D-1500 for microcrystalline wax and Saybolt Color Test ASTM-156 for paraffin wax.

It is another object of this invention to provide a novel static bed adsorbent which has a greatly increased capacity to adsorb color generating impurities from raw hard wax feedstock.

Another object of this invention resides in attainment of a wax finishing process which requires less harsh conditions of regeneration to renovate spent adsorbent, which is used in the decolorization of raw wax.

In one aspect an embodiment of this invention resides in a process for removing color-impurities from petroleum-derived wax which comprises contacting said petroleum-derived wax with an adsorbent comprising a refined inorganic oxide having pores of a size wherein at least 60% of said pores possess a size of less than 350 A at contacting conditions to adsorb said color-impurities on said refined inorganic oxide and to thereby produce a petroleum-derived wax having fewer color- or color-generating impurities than said petroleum-derived wax treated in said process.

Another embodiment of this invention is a process for excising colorforming impurities from a paraffin wax, a microcrystalline wax or mixtures thereof by means of static bed adsorption which comprises contacting said wax, at contacting conditions, with a solid absorption agent to remove, via adsorption said color-forming impurities, the improvement which comprises use, as said adsorbent, of a refined aluminum oxide having a pore size distribution wherein at least 60% of the pores have a size of less than 350 A.

Yet another embodiment of this invention resides in a wax finishing process which comprises percolation of said wax through a bed of refined aluminum oxide having at least 90% of the pores of a size of less than 350 A to obtain a wax having enhanced color purity.

Another embodiment of this invention resides in a multiple bed wax finishing process comprising passage of a raw wax containing color-forming or color impurities through a first of at least two static beds of refined aluminum oxide having a surface area of greater than 200 $m^2/gm$ but less than 350 $m^2/gms$ and a pore size distribution of at least 60% of the pores being of a size of less than 350 A to adsorb said color-forming or color impurities, at raw wax passage conditions, for a period of time sufficient to saturate said refined aluminum oxide and thereby result in a spent refined aluminum oxide as determined by said static bed's breakthrough point; ceasing said passage through said spent bed; passing said wax containing color impurities or color-forming impurities through a fresh or regenerated static bed of one of said at least two static beds of refined aluminum oxide having a surface area of greater than 200 $m^2/gm$ but less than 350 $m^2/gm$ and possessing a pore size distribution of at least 60% of the pores being of a size of less than 350 A to absorb said color-forming or color impurities, at raw wax passage conditions; regenerating said first spent static bed of aluminum oxide by the steps of: draining said spent bed of aluminum oxide to excise residuum wax contained therein; soaking said aluminum oxide in the presence of a naphtha solvent for a period of time sufficient to remove most of the wax from said bed; draining said naphtha solvent from said aluminum oxide bed; steam treating said aluminum oxide bed at a temperature of greater than 100° F. to excise any residuum naphtha solvent; and heating said aluminum oxide adsorbent in a furnace means for a period of time at a temperature of at least 1000° F. but less than 1250° F. to burn off, in the presence of an oxygen-containing gas, any residuum color impurities or color-forming impurities; and passing said wax containing color forming or color impurities again through said bed of aluminum oxide with regenerated capacity for adsorption of said color impurities or color-forming impurities.

EXAMPLES

The examples of this case demonstrate the unexpected adsorption capabilities derivative of the refined aluminum oxide adsorbent and also the unexpected increase in adsorption of a refined aluminum oxide having certain pore size distribution versus an ordinary aluminum oxide employed without regard to pore size distribution. This invention should not be limited to the various parameters of these examples as the same are included merely as exemplary of the unexpected results achieved by use of a specific aluminum oxide having requisite pore size distribution.

PREPARATION OF LOW-IMPURITY REFINED ALUMINUM OXIDE

Aluminum oxide (alumina) has long been known as a good catalyst base for different hydroprocessing catalysts. A quantity of one such catalyst base can be prepared utilizing commercial alumina powder with various binders and water after which the same is extruded, dried and calcined to its finished product. If desired, the alumina may be formed in 1/16" alumina extrudate spheres having a maximum surface area of 500 square meters per gram and a minimum surface area of 200 square meters per gram. The refined alumina derived for testing in Example II and III below was an alpha-alumina monohydrate hydrate containing 3 wt % maximum bayerite and gibbsite. The surface area of the alumina was on an average 300 square meters per gram with a density of 16 to 25 pounds per cubic foot. While it is certainly within the confines of this invention to prepare the alumina in any particle form necessary or desired, it is also possible that the alumina could be purchased on the open market as scrap catalyst fines, which are usually the throwaway from the catalyst support manufacture process. For Example IV, the catalyst is selected having specified predetermined pore size distribution. In Examples II and III herein, catalyst fines were used having the above physical dimensions.

While not desiring to be bound by any specific method of preparation for deriving the refined alumina, the following U.S. Patents are exemplary of some means by which pure alumina can be acquired. All of the teachings in re the method of preparing alumina supports of U.S. Pat. Nos. 4,301,037; 4,397,134; 4,003,851; 3,908,002 are now herein incorporated by reference.

EXAMPLE I

In this example, as well as Examples II and III hereinafter described, a microcrystalline wax feedstock was treated having the following properties:

TABLE I

| Properties of Feedstock Wax | |
|---|---|
| ASTM Color (D-1500) | Lt. 2.5 |
| Oil Content, % w (D-721) | 0.4 |
| Viscosity at 100° C., cSt (D-445) | 15.46 |
| Carbon Residue, % (D-524) | 0.1 |
| Melting Point, °F. (D-127) | 179 |
| Penetration at 77° F., dmm (D-1321) | 7 |
| R.I. at 100° C. (D-1747) | 1.4426 |
| Flash Point, °F. (D-92) | 595 |

A static bed of commercially purchased bauxite was maintained and the raw wax was allowed to percolate through the same at 240° F. The decoloration process was allowed to run at specified weight hourly space velocities (whsv) until the breakthrough point was realized, which is defined as the point at which the level of color impurities in the wax product became intolerable as measured by ASTM Color Test D-1500. This same breakthrough point was also applied in comparative Example II and III. The yield of decolored wax and life span of the adsorbent is set forth in Table II below.

EXAMPLE II

In this example microcrystalline feed wax of Table I was again treated, this time with calcined catalyst base fines at a temperature of 240° F. and at a weight hourly space velocity as shown in Table II. Again this system was run until the breakthrough point was realized wherein the effluent from the dewaxing unit contained an intolerable amount of color impurities, as measured by ASTM Color Test D-1500. The comparative yield of decolored wax is shown in Table II.

A comparison of the average yield of the bauxite adsorbent versus the aluminum oxide base fines adsorbent shows as much as a 400% improvement. This dichotomy is also dramatically depicted in FIG. 2 of the drawings.

TABLE II

| Adsorption of Bauxite Alumina Base Fines | Temp °F. | WHSV $HR^{-1}$ | Yield[1] W/W |
|---|---|---|---|
| 6% Volatiles Bauxite | 240 | 0.25 | 4.86 |
| 20/60 Mesh | 240 | 0.24 | 4.29 |
| No regeneration | 240 | 0.23 | 4.47 |
| | 240 | 0.25 | 4.53 |
| Calcined Alumina Catalyst Base | 240 | 0.41 | 18.92 |
| 20/60 Mesh | 240 | 0.43 | 19.23 |
| No regeneration | 240 | 0.39 | 18.45 |
| | Average Yield[2] W/W | | |
| 6% Volatiles Bauxite | 4.54 ± 0.37 | | |

TABLE II-continued

| Adsorption of Bauxite Alumina Base Fines | |
|---|---|
| Catalyst Base | 18.87 ± 0.97 |

[1]Color breakthrough, i.e. > 1.5 ASTM color for the bulk sample.
[2]Averages at the 95% confidence level.

EXAMPLE III

In this example the claimed alumina base fines of Example II were regenerated by first soaking the spent adsorbent in a naphtha solvent for 4 hours followed by a steam treatment for 6 hours at 250° F. The adsorbent is then placed in a furnace and elevated to a temperature of about 1050° F. in the presence of ambient air for a period of time sufficient to regenerate as much as feasible the adsorption qualities of the alumina.

The regenerated alumina was again utilized to determine the adsorption capabilities of same as performed in Example I with bauxite and Example II with the refined alumina. Table III shows the average yield attained at a time immediately before this same breakthrough point of color causing impurities. It was expected that a decrease would occur in the adsorption capabilities of the adsorbent after regeneration. However, the percolation in the static bed, even though lower than shown in Table II commensurate with Experiment II, did still greatly outperform the unregenerated bauxite absorbent which itself usually shows less efficiency subsequent to regeneration.

TABLE III

| Adsorption of Catalyst Base Fines After Regeneration<br>Calcined Alumina Catalyst Base<br>CB 84 - 101 KC 300T<br>20/60 Mesh | Temp °F. | WHSV $HR^{-1}$ | Yield[1] W/W |
|---|---|---|---|
| 1st Regeneration | 240 | 0.39 | 14.50 |
| | 240 | 0.38 | 12.62 |
| 1st Regeneration (56% w) | 240 | 0.33 | 11.48 |
| 2nd Regeneration (44% w) | | | |

[1]Color breakthrough, i.e. > 1.5 ASTM color for the bulk sample.

The surprising results shown in these two tables are again depicted in FIG. 2. It was surprising that the refined alumina resulted in an adsorbent capable of outperforming the bauxite by as much as 400% before regeneration and by as much as 100% even after regeneration.

EXAMPLE IV

In this example, a microcrystalline wax feedstock was treated having the following properties as set forth in Table IV.

TABLE IV

| Properties of Wax Feedstocks | |
|---|---|
| ASTM Color (D-1500) | Lt. 2.5 |
| Oil Content, % w (D-721) | 0.4 |
| Viscosity at 100° C., cSt (D-445) | 15.5 |
| Carbon Residue, % (D-524) | 0.1 |
| Melting Point, °F. (D-127) | 179 |
| Penetration at 77° F., dmm (D-1321) | 7 |
| R.I. at 100° C. (D-1747) | 1.443 |
| Flash Point, °F. (D-92) | 595 |

The process procedures of Examples II and III were followed with three different adsorbents. One absorbent was catalyst base fines with nearly 90% of the pore distribution of a size less than 350 Å. A second was catalyst base fines having 60% of the pores greater than 350 Å and a third was bauxite, with a typical pore distribution of greater than 50% of the pores greater than 350 Å. This system was run until the breakthrough point was realized for each absorbent wherein the effluent from the dewaxing unit contained an intolerable amount of color impurities as measured by ASTM Color Test D-1500. The comparative yield of decolored wax and physical characteristics of the adsorbents are shown in Table V.

TABLE V

| | Catalyst Fines | Catalyst Fines (8 Months Aged) | 1984 Bauxite |
|---|---|---|---|
| SA | 239 $m^2/g$ | 99 $m^2/g$ | 180 $m^2/g$ |
| PV | 0.69 cc/g | 0.4 cc/g | .25 cc/g |
| Pore Size Distribution, % | | | |
| <50 A | 4.6 | 3.5 | 17.0 |
| 50-70 A | 21.4 | 3.5 | 6.6 |
| 70-100 A | 44.9 | 5.9 | 5.7 |
| 100-150 A | 14.4 | 10.8 | 6.0 |
| 150-350 A | 5.6 | 16.6 | 11.7 |
| >350 A | 9.1 | 59.7 | 53.0 |
| Temp °F. | 240 | 240 | 240 |
| WHSV $Hr^{-1}$ | 0.4 | 0.4 | 0.4 |
| Yield | 2,780 | 300 | 250 |
| ΔYield | 11.1 | 1.2 | 1.0 |

This is commensurate with FIG. III of the drawings.

BRIEF DESCRIPTION OF THE INVENTION

Succinctly, this invention is concerned with a wax finishing process utilizing a refined alumina static bed of certain pore size to adsorb color generating impurities from a hard wax material.

DETAILED DESCRIPTION OF THE INVENTION

Raw wax derived from a solvent lubricating oil dewaxing system contains color forming impurities as a result of the indigenous quantity of such solvents as methylethyl ketone and toluene left over from the solvent dewaxing system. Other color forming impurities are also indigenous to the wax in addition to compounds which will create color impurities if allowed to remain in the wax over a relatively short period of time. It is essential to remove color impurities in addition to any color forming precursors from the raw wax. As set forth above, it is conventional to treat these raw waxes with the mineral ore bauxite.

An adsorbent shown to possess an increased capacity of up to 400% vis-a-vis the bauxite is a refined inorganic oxide. This oxide is preferably aluminum oxide but could also be any other inorganic oxide such as silicon oxide, aluminum-silicon oxide, aluminum-gallium oxide, aluminum-magnesium oxide, aluminum-zirconium oxide, magnesium oxide, zirconium oxide, etc. or mixture thereof. The aluminum oxide can be purchased on the open market as catalyst base supports or, if desired, a refiner or manufacturer could utilize the flotsam from the aluminum oxide base support preparation technique which are sometimes referred to as catalyst base fines. The refined inorganic oxide, regardless of the means or source of acquisition, is sorted or prepared to acquire a pore size distribution such that at least 60% of the pores have a size less than 350 Å. Preferably, pore size distribution is achieved such that 90% of the pores have a size less than 350 Å. Catalyst base fines of requisite pore size distribution can be acquired from control of the manufacture technique, which is readily available once it is determined what pore size distribution is desired.

The surface area of the particular alumina should be from about 200 square meters per gram to about 500 square meters per gram and preferably from about 250 square meters per gram to about 350 square meters per gram. This is inconsistent with the surface area of the bauxite, which is usually composed of alumina particles having a surface area of 120 to 125 square meters per gram.

The catalyst fines or catalyst base supports, either prepared or purchased, will have been dried and calcined prior to use herein which further modifies the adsorption capabilities of the adsorbent. The adsorption conditions for treating the raw wax include a temperature from about 180° F. to about 250° F. and a pressure of about 1 atmosphere to about 2 atmospheres. After the static bed has become saturated with the color forming impurities, such as methylethyl ketone, toluene, various aldehydes and carboxylic acids, the refined alumina can be regenerated. This procedure can be performed by a regeneration technique which concerns first draining the wax to a rundown tank and then soaking the spent adsorbent bed in a naphtha solvent for a period of time to insure complete removal of the wax and color-forming agents. Thereafter the adsorbent is treated with steam to remove any naphtha solvent which may be reused after capture or discarded via further hydrocarbon processing. Once the adsorbent is impurity- and naphtha- free, the same is treated in an air environment at a temperature of over 1000° F. but less than 1250° F., either in situ or in a multiple hearth furnace, such as a Nichols-Herreshoff multiple-hearth furnace, to eliminate all the color-impurities from the adsorbent.

This regeneration procedure can be performed in situ or the alumina may be extracted from the adsorbent bed and regenerated off site. It is contemplated within the scope of this invention that the alumina be contained in more than one bed or a plurality of swing beds so that one (spent) may be regenerated while the other (fresh) is functioning to excise the color forming entities.

DETAILED DESCRIPTION OF THE INVENTION

Figure 1:
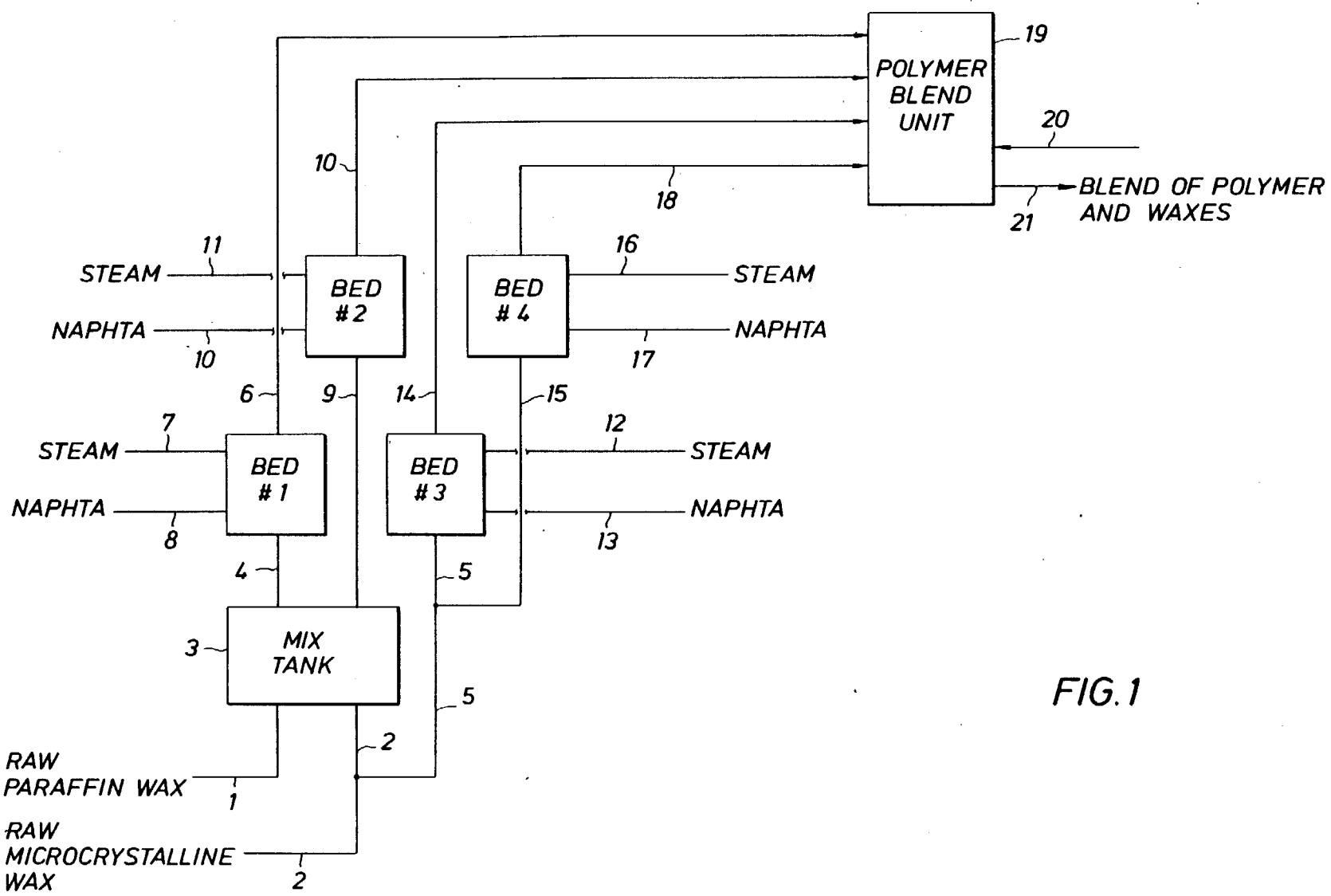
FIG. 1 is a schematic flow scheme contemplated within this process.

FIG. 1 shows two streams acquired from a solvent dewaxing step inclusive of a raw paraffin wax 1 and a raw microcrystalline wax 2. These may be either admixed in mix tank 3 or individually charged to respective Beds 1 and 3 via conduits 4 and 5. Beds Nos. 1, 2, 3 and 4 can be operated in parallel flow so that there need be no down time for either the combination treatment of the raw paraffin and microcrystalline wax or the individual color removing impurity procedure of this invention. In operation, if the mixture of the raw paraffin and microcrystalline wax is utilized, Bed no. 1 is used until it becomes saturated with the color forming impurities, i.e. until the breakthrough point is realized. At that time the effluent passing in conduit 6 ceases and Bed No. 1 is drained and regenerated by steam via conduit 7, naphtha via conduit 8 and a hearth furnace. Thereafter flow of feed to Bed No. 2 in conduit 9 is started and Bed No. 2 takes over the function of the spent alumina existent in Bed No. 1. The effluent from Bed No. 2 is removed in conduit 10. After Bed No. 2 reaches its breakthrough point it may likewise be regenerated via respective steam stream 11, naphtha stream 10 and a not shown hearth furnace. These swing bed systems may be utilized for the combination of paraffin and microcrystalline waxes or simply for the paraffin wax. If the microcrystalline wax is to be individually treated, conduit 5 will be charged and thereby pass microcrystalline wax to Bed No. 3 containing the refined low-impurity aluminum oxide adsorbent. After the breakthrough point is arrived at in Bed No. 3, steam in conduit 12, naphtha in conduit 13 and an off-site hearth furnace are utilized to regenerate the adsorbent. At this time the flow of material through conduit 14 stops and the flow of the raw microcrystalline wax in conduit 15 is started to Bed No. 4, which, after its breakthrough point is arrived at, is regenerated via steam stream 16, naphtha stream 17 and an off site hearth furnace. The effluent from Bed No. 4 is then withdrawn in conduit 18. All of the streams may then be used for their desired purpose or they can be channeled to polymer blend unit 19. The polymer blending procedure is an optional step taken merely to place the wax in another product format. It is conceivable, and even preferred, that the refined raw wax is sold per se. Any type of polyethylene, polybutylene or polypropylene polymer in conduit 20 and any desired amount of refined wax in conduits 6, 10, 14 and/or 18 are utilized to blend the applicable polymer with the captured relatively color-pure wax. The blend of materials may then be removed in conduit 21 for use as a coating of various materials.

Figure 2:
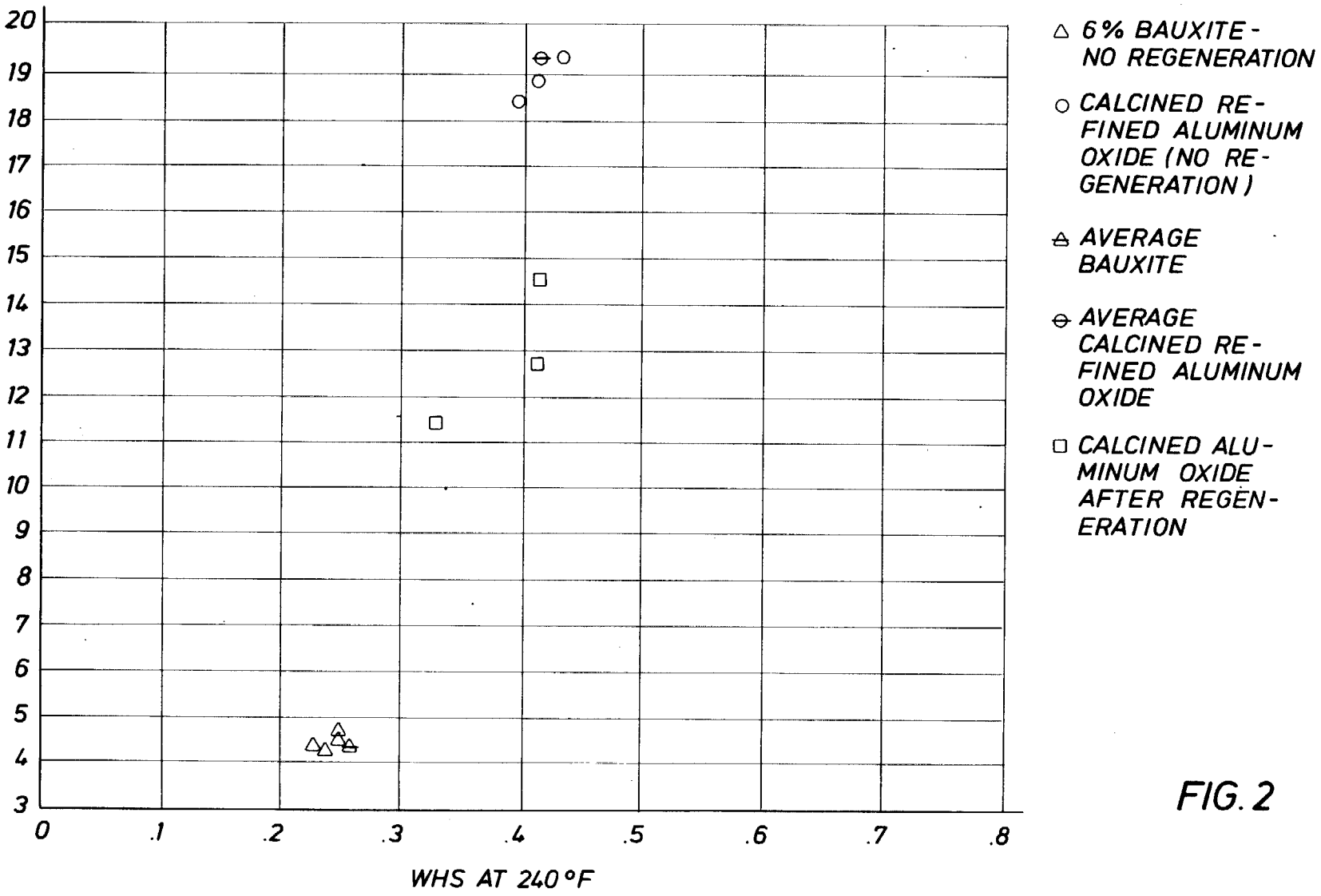
FIG. 2 is a graphic showing of the same breakthrough point of the different adsorbents and highlights the unexpected longer breakthrough point achieved utilizing the refined alumina adsorbent.

FIG. 2 is self explanatory graphical depiction of the unexpected experimental results above tabularly set forth in Tables II and III.

Figure 3:
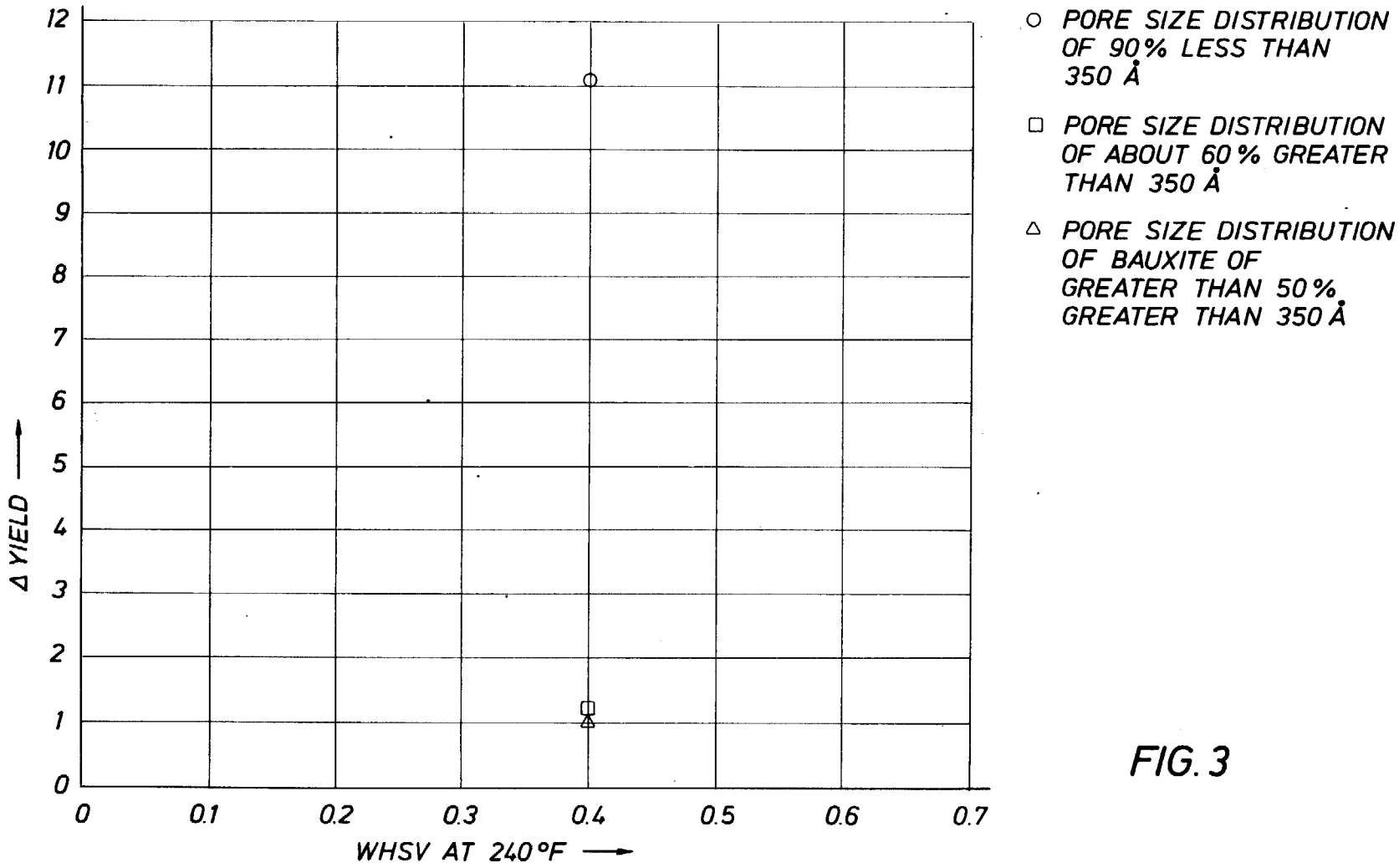
FIG. 3 is a graphic showing of the same breakthrough point of adsorbents having different pore size distribution and highlights the unexpected longer breakthrough point achieved utilizing the refined alumina adsorbent with select pore size distribution.

FIG. 3 is self explanatory graphical depiction of the unexpected experimental results above tabularly set forth in Table V.

We claim as our invention:

1. A process for removing color-impurities from petroleum-derived wax which comprises contacting said petroleum-derived wax with an adsorbent comprising a refined low-impurity aluminum oxide having pores of a size wherein at least 90% of said pores possess a size of less than 350 A, at contacting conditions, to adsorb said color-impurities on said refined low-impurity aluminum oxide and to produce a petroleum-derived wax having fewer color-impurities than said petroleum-derived wax treated in said process.

2. The process of claim 1, wherein said petroleum-derived wax is derived from a lubricating oil solvent dewaxing process.

3. The process of claim 2, in which said solvent is an admixture of methylethyl ketone and toluene, both of which are present in relatively small quantities in said petroleum-derived wax and are at least a partial portion of said color-impurities.

4. The process of claim 1 wherein said contacting conditions include a temperature of about 180° F. to about 250° F. and a pressure of about 1 atmosphere to about 2 atmospheres and a space velocity of about 0.8 to about 0.25.

5. In a process for excising color-forming impurities from a paraffin wax, a microcrystalline wax or mixtures thereof by means of static bed adsorption which comprises contacting said wax, at contacting conditions, with a solid adsorption agent to remove via adsorption said color-forming impurities, the improvement which comprises, use as said adsorbent, of a refined aluminum oxide having at least 90% of its pore size less than 350 A.

6. The process of claim 5 wherein said contacting conditions include a temperature of about 180° F. to about 250° F. and a pressure of about 1 atmosphere to about 2 atmospheres.

7. The process of claim 5 wherein said aluminum oxide is present in the form of 1/16 inch spherical extrudate particles.

8. The process of claim 5 wherein said paraffin wax, crystalline wax or combinations thereof, after excising the color-forming impurities is blended with a polyethylene or polypropylene polymer.

9. A microcrystalline wax finishing process which comprises percolation of said microcrystalline wax through a bed of refined aluminum oxide wherein at least 90% of the pores of said aluminum oxide are of a size of less than 350 A, to obtain a relatively color free microcrystalline wax as measured by ASTM Color Test D-1500.

10. A paraffin wax finishing process which comprises percolation of said paraffin wax through a bed of refined aluminum oxide, wherein at least 90% of the pores of said aluminum oxide are of a size of less than 350 A, to obtain a relatively color-free paraffin wax as measured by Saybolt Color Test ASTM D-156.

11. A multiple bed wax finishing process comprising (1) passage of a wax containing color-forming or color impurities through a first of at least two static beds of low-impurity refined aluminum oxide having a surface area of greater than 200 $m^2/gm$ but less than 350 $m^2/gm$ and 90% of the pores of a size less than 350 A to absorb said color-forming or color impurities, at passage conditions, for a period of time sufficient to saturate said refined aluminum oxide and thereby result in a spent refined aluminum oxide as defined by said static bed's break-through point, (2) ceasing said passage through said spent bed, (3) passing said wax containing color-forming or color impurities through a fresh or regenerated static bed of one of said at least two static beds of refined aluminum oxide having a surface area of greater than 200 $m^2/gm$ but less than 350 $m^2/gm$ to absorb said color-forming or color impurities, at passage conditions, (4) regenerating said first spent static bed of aluminum oxide by the steps of:

(a) draining said spent bed of aluminum oxide to excise all residuum wax content;

(b) soaking said aluminum oxide in the presence of a naphtha solvent for a period of time sufficient to remove the absorbed impurities from said feed;

(c) draining said naphtha solvent from said aluminum oxide bed;

(d) steam treating said aluminum oxide bed at a temperature of greater than 100° F. to excise any residuum naphtha solvent; and (e) heating said aluminum oxide adsorbent in a furnace means for a period of time at a temperature of at least 1000° F. but not greater than 1250° F. to burn off, in the presence of any oxygen-containing gas, any residuum color impurities or color-forming impurities; and (5) passing said wax containing color-forming or color impurities again through said bed of aluminum oxide with regenerated capacity for said color-impurities or color formining impurities.

12. A continuous multiple regeneratable static bed wax decolorization process which comprises:

(a) passing wax containing color impurities through a first of at least two static regeneratable adsorption beds consisting essentially of a synthetic calcined alumina having a surface area of from 200 $m^2/gm$ to about 500 $m^2/gm$ and having a pore size distribution wherein at least 90% of said pores have a size of less than 350 A to absorb said color impurities at a temperature of about 180° F. to about 250° F. and a pressure of about 1 to about 2 atmospheres for a period of time sufficient to saturate said synthetic calcined alumina and to thereby produce a spent synthetic calcined alumina static bed as defined by said alumina's color break-through point;

(b) ceasing said passage of said wax stream through said spent synthetic calcined alumina;

(c) passing said wax containing said color impurities through a second regeneratable static adsorption bed of said at least two static beds, said second static bed consisting essentially of a synthetic calcined alumina having a surface area of from 200 $m^2/gm$ to about 500 $m^2/gm$ and having a pore size distribution wherein at least 90% of said pores have a size of less than 350 A to absorb said color impurities at a temperature of about 180° F. to about 250° F. and a pressure of about 1 to 2 atmospheres;

(d) regenerating said first static bed concomitant with said adsorption in said second static bed in step (c) by the regeneration procedure of:

(i) draining said spent first static bed of alumina to excise all residuum wax content therefrom;

(ii) soaking said spent first static bed in the presence of a naphtha solvent for a period of time sufficient to remove said adsorbed color impurities from said spent first static bed;

(iii) draining said naphtha solvent containing said color impurities from said spent first static bed;

(iv) treating said spent first static bed with steam at a temperature greater than 100° F. to excise any residuum naphtha solvent from said procedure of step iii); and (v) heating said first static bed in a furnace at a temperature of at least 1000° F. but not greater than 1250° F. for a period of time sufficient to burn off, in the presence of an oxygen-containing gas, any residuum color impurities and to prepare a freshly regenerated calcined alumina static bed;

(e) passing said wax containing said color impurities through said regenerated first static bed of at least two static bed to adsorb said color impurities at said range of temperature and said range of pressure as set forth in step (a); and (f) regenerating said second static bed of step (c), after said second static bed has become spent as defined by said alumina's color breakthrough point, by the regeneration procedures set forth in steps (i) through (v).

13. The process of claim 12 wherein said wax containing color impurities is derived from solvent dewaxing of a lubricating oil.

14. The process of claim 13 wherein said solvent is an admixture of methylethyl ketone and toluene and wherein said ketone and said toluene comprise a portion of said color impurities.

15. The process of claim 12 wherein said decolored wax is blended with a polyethylene or polypropylene polymer.

* * * * *